United States Patent [19]

Long

[11] Patent Number: 4,890,400

[45] Date of Patent: Jan. 2, 1990

[54] BUCKET ATTACHMENT FOR TRACTOR BLADE

[76] Inventor: Jeffrey D. Long, 6244 Groveland Rd., Pipersville, Pa. 18947

[21] Appl. No.: 263,003

[22] Filed: Oct. 27, 1988

[51] Int. Cl.[4] ..... E02F 3/00

[52] U.S. Cl. ..... 37/117.5; 37/118 R; 37/DIG. 12; 172/815; 414/726

[58] Field of Search ..... 37/117.5, DIG. 3, DIG. 12, 37/118 R, 118 A; 414/685, 726, 722, DIG. 912; 172/817, 815

[56] References Cited

U.S. PATENT DOCUMENTS

| | | | |
|---|---|---|---|
| 2,262,415 | 11/1941 | Williams | 414/912 |
| 2,812,595 | 11/1957 | Drott | 37/117.5 |
| 2,824,439 | 2/1958 | Roemer | 37/117.5 |
| 3,034,237 | 5/1962 | Wolfe | 37/117.5 |
| 4,030,626 | 6/1977 | Durham | 37/118 A |
| 4,566,844 | 1/1986 | Campin | 414/726 |
| 4,633,601 | 1/1987 | Fleck | 414/726 |

*Primary Examiner*—Richard J. Johnson

*Attorney, Agent, or Firm*—Joseph W. Molasky & Assocs.

[57] ABSTRACT

An attachment adapted to cooperate with a snow blade or the like of a tractor to provide a dump bucket at the front end thereof is disclosed. The attachment enhances the materials moving capability of the tractor by enabling the tractor to pick up material in a bucket and move it to a desired location. The attachment includes a bucket structure pivotally mounted on the snow blade for movement between a closed or loading position and an open or dumping position.

17 Claims, 4 Drawing Sheets

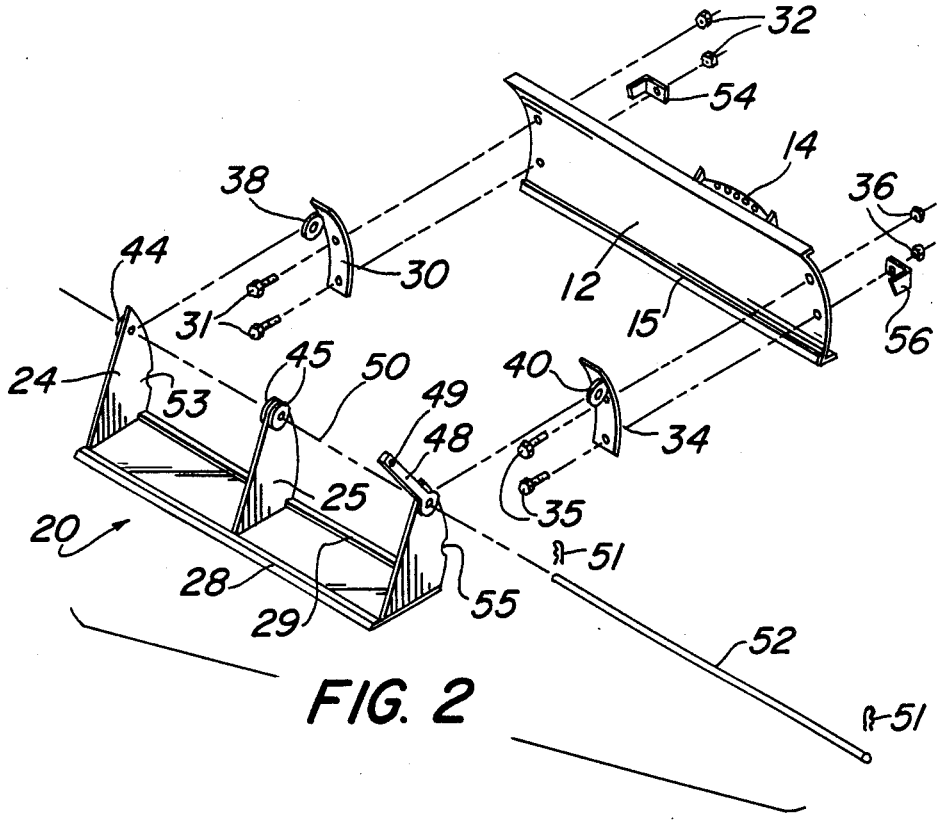
FIG. 2
FIG. 3
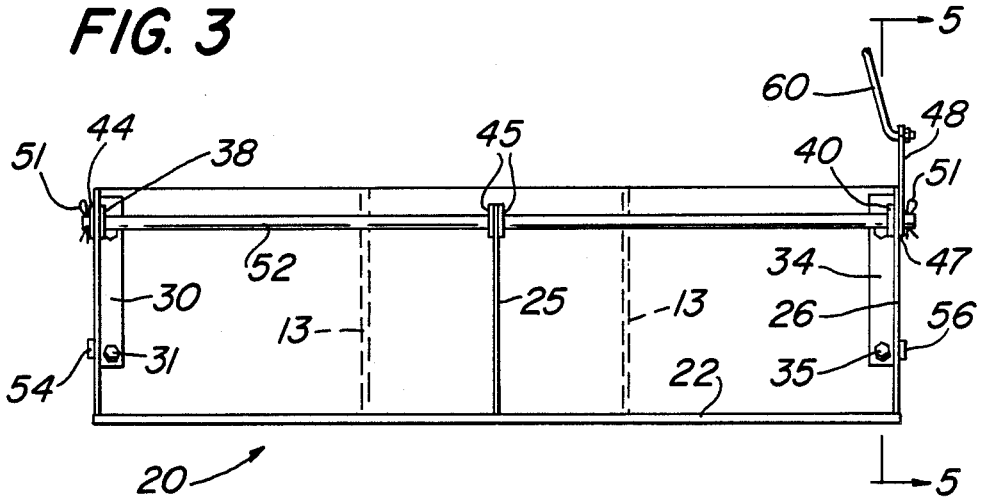

BUCKET ATTACHMENT FOR TRACTOR BLADE

BACKGROUND OF THE INVENTION

1. Field of the Invention

This invention relates to an attachment for a tractor of the type having a snow or plow blade mounted on the front end thereof for moving snow or other material from one place to another. The tractors of this type in use today are limited to moving the material by a "pushing" action. Accordingly, a material moving job can require an excessive amount of time and some jobs cannot be performed by simply pushing the material around from place to place.

2. Description of the Prior Art

Prior art patents known to the applicant are U.S. Pat. Nos. 4,550,512 and 4,692,089. These patents do not disclose any attachments for converting a tractor from a plow-type vehicle to one having a dump bucket thereon.

SUMMARY OF THE INVENTION

The present invention comprises an attachment constructed and arranged to cooperate with a snow blade or the like to provide a dump bucket at the front end of a garden-type tractor or the like. The attachment in accordance with the invention enhances the materials moving capability of the tractor by enabling the tractor to pick up the material in the bucket and move it to a desired location whereat the material can be dumped. The attachment in accordance with the invention is designed for moving material such as snow, dirt, sand, stones and similar materials which are typically moved by dump buckets.

Briefly stated, the attachment in accordance with the invention comprises a generally flat bottom adapted to extend along the length of the snow blade when attached thereto and a pair of side members mounted on the ends of the bottom to extend transversely thereto. The bottom and the side members are constructed and arranged to form a rigid bucket structure having a shape adapted to cooperate with the snow blade to form a bucket for carrying material. The attachment also includes means for pivotally mounting the bucket structure on the snow blade to extend forwardly therefrom for pivotal movement between a closed or loading position and an open or dumping position.

BRIEF DESCRIPTION OF THE DRAWINGS

FIG. 2 is an exploded isometric view showing the attachment in accordance with the invention that is mounted on the tractor shown in FIG. 1.

FIG. 3 is a front elevational view of the attachment in accordance with the invention shown in FIG. 1.

DESCRIPTION OF THE PREFERRED EMBODIMENTS

Figure 1:
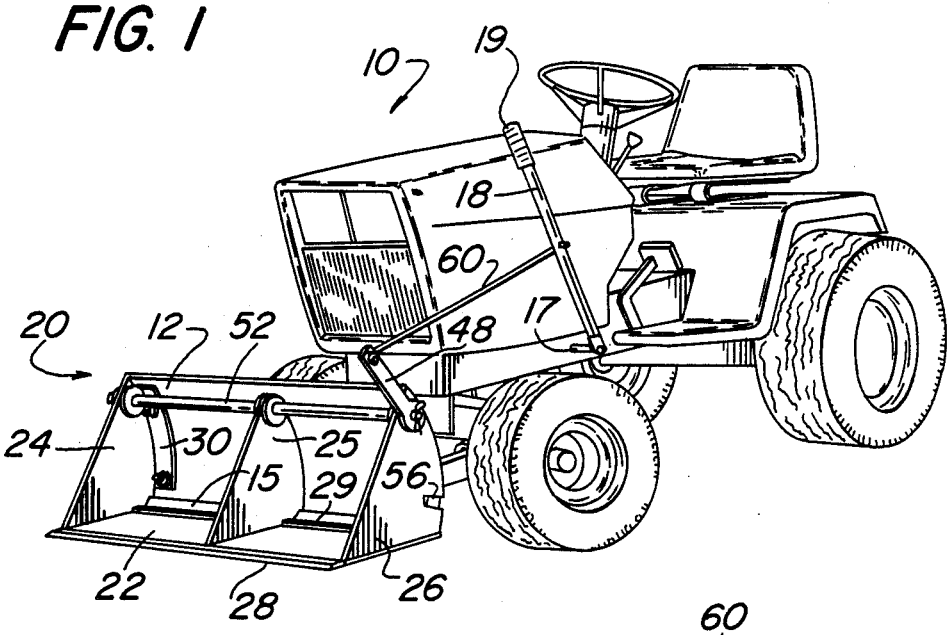
FIG. 1 is a perspective view showing a garden tractor having the attachment in accordance with one embodiment of the invention mounted thereon.

In FIG. 1 there is shown a garden-type tractor 10 having a snow blade 12 mounted on the forward end thereof in a conventional manner by means of a support 14 mounted on the front end of a frame member 16 extending forwardly from the tractor frame as is conventional in the art. The tractor 10 and the snow blade 12 mounted thereon shown in FIG. 1 are typical of this type of vehicle presently in use and it is this type of vehicle to which the present invention is applicable. As is conventional, the snow blade 12 extends generally vertically, has a curved shape and is provided with a pair of curved braces 13 (FIG. 7) and a bottom strip 15.

Referring to the embodiment of the invention shown in FIGS. 1–6, the attachment comprises a rigid bucket structure 20 which includes an elongated flat bottom 22, a first side member 24 mounted on one end of the bottom 22 to extend transversely thereto and a second side member 26 mounted on the other end of the bottom 22 to extend transversely thereto. The side members 24 and 26 are welded to the ends of the bottom 22 at their forwardly extending bottom straight edges and have curved rear edges which have a shape similar to the curved shape of the snow blade 12. The bucket structure 20 also comprises a third member 25 constructed and arranged in a manner similar to the side members 24 and 26 and mounted at a medial location along the length of the bottom 22 as shown in the Drawings. The member 25 is also welded to the bottom 22 at its straight bottom edge as best shown in FIGS. 1 and 2. The bottom 22 has a metal strip 28 welded thereto to extend along the front edge thereof and a metal strip 29 welded thereto to extend along the back edge thereof for sealing contact with bottom strip 15 of snow blade 12. Strip 28 is made of a hard impact resistant material and has a tapered configuration to form a sharp edge to facilitate movement of the bottom 22 into the material during a loading procedure. It will be apparent that the bottom 22, the members 24–26, the metal strips 28 and 29 are all welded together to form the rigid bucket structure 20. Also, this bucket structure 20 has a shape such that it cooperates with the snow blade 12 to form a dump bucket for carrying material as is apparent from a consideration of the Drawings.

Means are provided for pivotally mounting the bucket structure 20 on the snow blade 12 to extend forwardly therefrom. Such means comprises a first bracket 30 mounted adjacent one end of the snow blade 12 by means of a pair of bolts 31 and cooperating nuts 32, and a second bracket 34 mounted adjacent the other end of the snow blade 12 by means of a pair of bolts 35 and cooperating nuts 32, as best shown in FIG. 2. The brackets 30 and 34 are curved to conform to the shape of the snow blade 12 so that they can be mounted on and in contact with the front face thereof. The brackets 30 and 34 are provided with pivot supports 38 and 40 in the form of annular shaped lugs which are welded thereto to project forwardly from the snow blade 12. The brackets 38 and 40 are mounted on the snow blade 12 so that the holes of the lugs forming the pivot supports 38 and 40 are in alignment with a horizontally extending axis. The pivotal mounting means also comprises pivot supports mounted at each of the members 24–26. To this end, the pivot support at the side member 24 comprises an annular washer 44 welded to the outside face thereof, the pivot support at the medial member 25 comprises a pair of annual washers 45 welded on opposite faces thereof, and the pivot support on the side member 26 comprises an annular end portion 47 of a crank arm 48 which is welded to side member 26 on the outer face thereof, as shown in the Drawings. The parts are constructed and arranged so that the pivot supports 44, 45 and 47 have their central holes in axial alignment with an axis indicated at 50 in FIG. 2. The pivot means also comprises a pivot shaft 52 which is adapted to extend through the holes in the pivot supports 44, 45 and 47 and the holes of pivot supports 38 and 40 to provide a pivotal axis, as shown in FIG. 3, for example. The pivot shaft 52 is secured in position by a pair of cotter pins 51 mounted in the ends thereof as best shown in FIG. 3.

Figure 4:
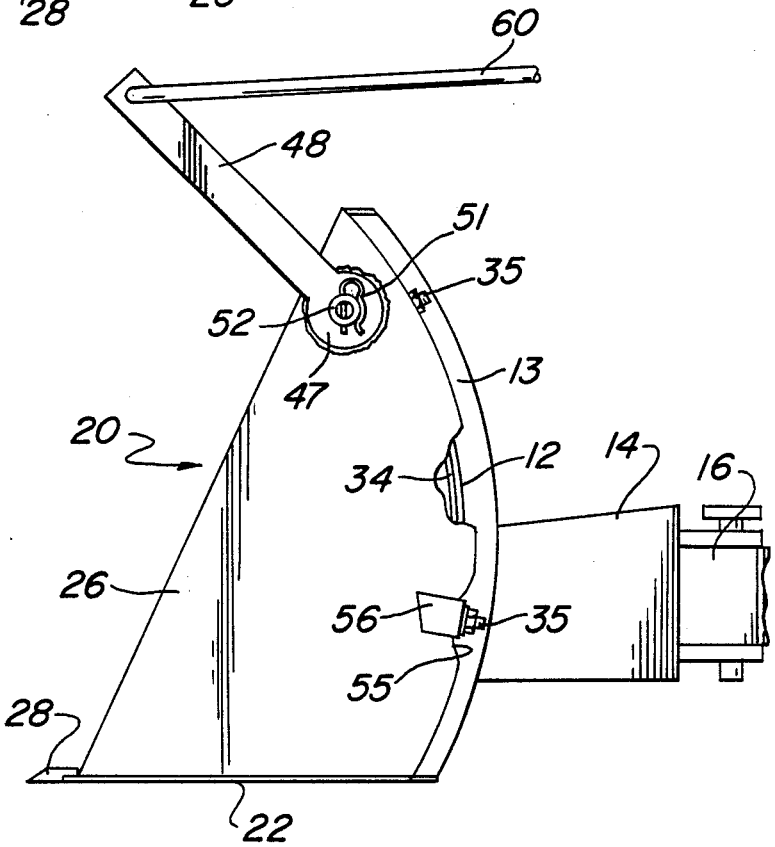
FIG. 4 is a right side elevational view of the attachment shown in FIG. 3.

Means are provided for guiding the bucket structure 20 into and stopping the bucket structure 20 at the closed position thereof shown in FIGS. 1 and 4. Such means comprises a pair of brackets 54 and 56 having a generally right angular shape as shown in FIG. 2. The brackets 54 and 56 are mounted on the snow blade 12 by means of the lowermost of the cooperating bolts and nuts 31, 32 and 34, 35, respectively, which cooperate with one leg of brackets 54 and 56 to mount the same on the back side of snow blade 12. The brackets 54 and 56 are mounted so that the other leg thereof extends forwardly from the adjacent end of snow blade 12 to embrace the curved back edge of side members 24 and 26 in the closed position of the bucket structure 20 as shown in the Drawings. The curved back edges of side members 24 and 26 come into contact with the brackets 54 and 56 at notched portions 53 and 55 of the side members 24 and 26, respectively, when the bucket structure 20 is in its closed position.

Figure 5:
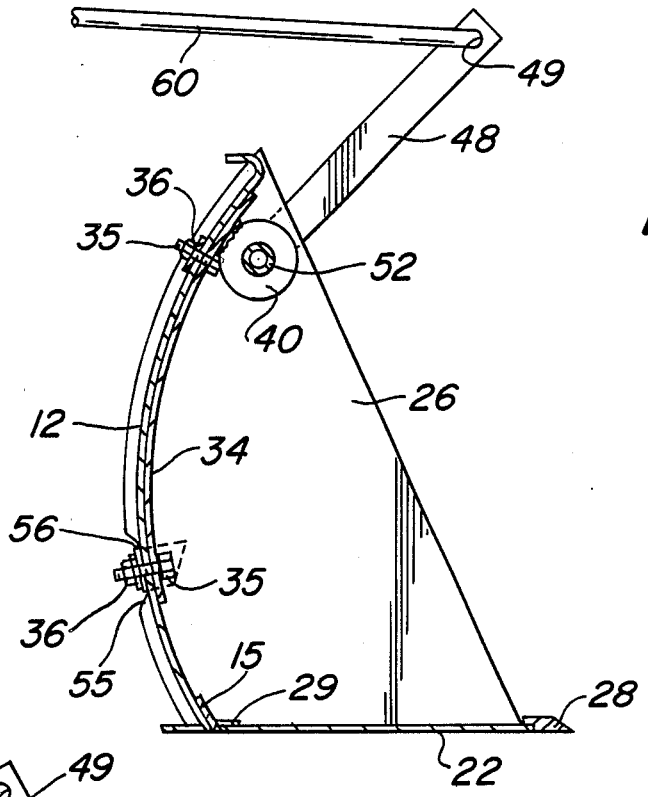
FIG. 5 is a sectional view taken on line 5–5 of FIG. 3.

As can be seen from a consideration of FIGS. 1, 4 and 5, the side members 24 and 26 and the cooperating stops 54 and 56 are constructed and arranged so that the side members 24 and 26 overlap the end portions of the snow blade in the closed position of the bucket structure 20. The purpose of this arrangement is to prevent the escape of material from the interior chamber of the bucket structure 20 when it is in its closed position and during the movement of the tractor 10 to transport the contained load.

Figure 6:
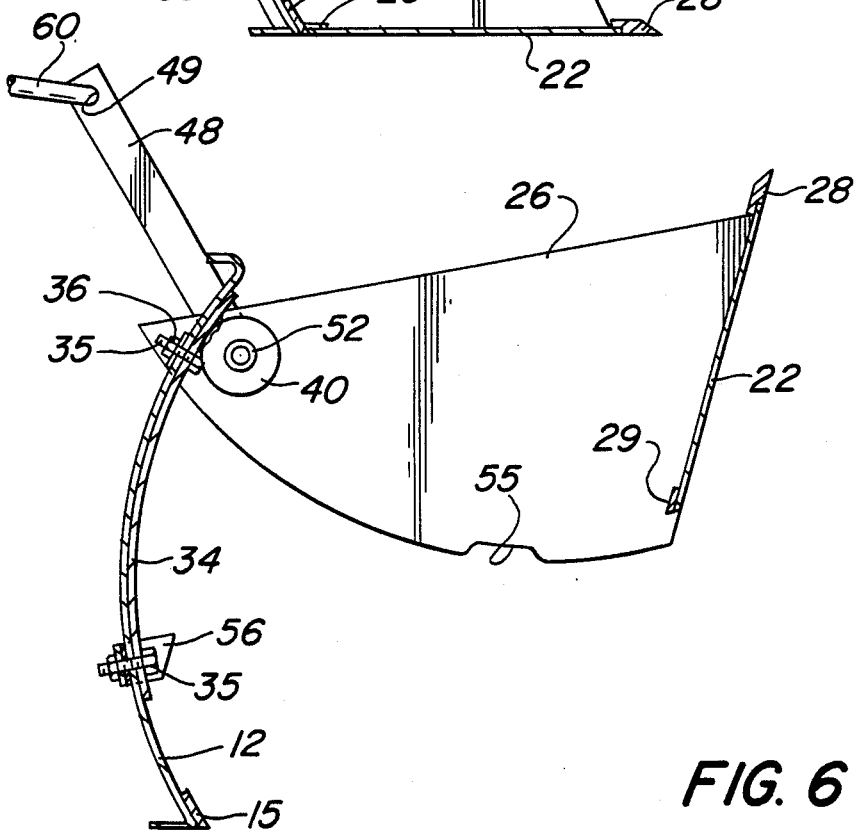
FIG. 6 is a view similar to FIG. 5 showing the bucket structure in the open position.

The bucket structure 20 and the mounting therefor are constructed and arranged so that when mounted on the front end of the snow blade 12, it can be pivoted between a closed or LOAD position or an open or DUMP position, which positions are similar to the positions of dump buckets in general use today on front end loaders, for example. The closed position of the bucket structure 20 is shown in FIGS. 1, 3, 4 and 5 and the open position is shown in FIG. 6. With the bucket structure 20 in its closed position, the tractor 10 can be maneuvered to drive the bucket structure 20 into the material to be moved so as to accummulate a substantial amount of material in the bucket chamber located between the confines of the bottom 22, the side members 24 and 26 and the snow blade 12. In the loaded position of the bucket structure 20, the tractor 10 can be operated to lift up the snow blade 12, and the bucket structure 20 attached thereto, along with the material picked up, and move to a desired dumping location. When it arrives at the dumping location, the bucket structure 20 is moved from the closed position (as shown in FIG. 5) to the open position (as shown in FIG. 6) to deposit the transported material within the bucket structure 20 onto the ground therebeneath.

Means are provided for actuating the bucket structure 20 between the closed and open positions thereof described above. Such means comprises the crank arm 48 welded to the outer side of side member 26 of the bucket structure 20. At its upper end, the crank arm 48 has a hole 49 therein to which one end of a link arm 60 is attached. The link arm 60 extends from the upper end of crank arm 48 rearwardly for connection to a control arm 18 pivotally mounted at its lower end by a bolt means 17 on the side of a tractor 10 at a location accessible to the operator of the tractor 10 as is shown in FIG. 1. The parts are constructed and arranged so that by the manual moving of the control arm 18 by the operator grasping the same at a handle 19 at its upper end, it is possible to manually move the crank arm 48 between the forward position shown in FIG. 5 and the back position shown in FIG. 6, whereby the bucket structure 20 is moved by means of link arm 60 from the closed position thereof to the open position thereof. The bucket structure 20 can be returned to the closed position by the operator manually moving the upper end of the crank arm 18 forwardly to return it to the position shown in FIG. 5.

In the use of a tractor 10 having the attachment in accordance with the invention thereon, the tractor 10 is simply maneuvered so that the bottom 22 of the bucket structure 20 is placed in a lower position extending along the ground and the load (which may be dirt, gravel, snow or the like) is scooped into the bucket structure 20 by the forward movement of the tractor 10. Essentially the tractor 10 is operated in the same manner as many front loaders in use today. The tractor 10 is then moved to the position where the load is to be dumped and the bucket is unloaded by simply pulling the control lever 18 rearwardly which actuates the bucket structure 20 to the raised position and allows the load to fall between the raised bottom 22 and the snow blade 12 to dump onto the ground at the dumping position.

It will be apparent that by reason of the simple design of the attachment in accordance with the invention, the bucket structure 20 can be quickly and easily attached to the snow blade 12. Moreover, the attachment is achieved by standard and inexpensive parts. Furthermore, the attachment in accordance with the invention can be designed to fit most of the plow (or bulldozer) blades or snow blades in use today. Furthermore, another feature of the invention is that by reason of the simple design of the attachment, it can be easily retrofitted to existing tractors.

Figure 7:
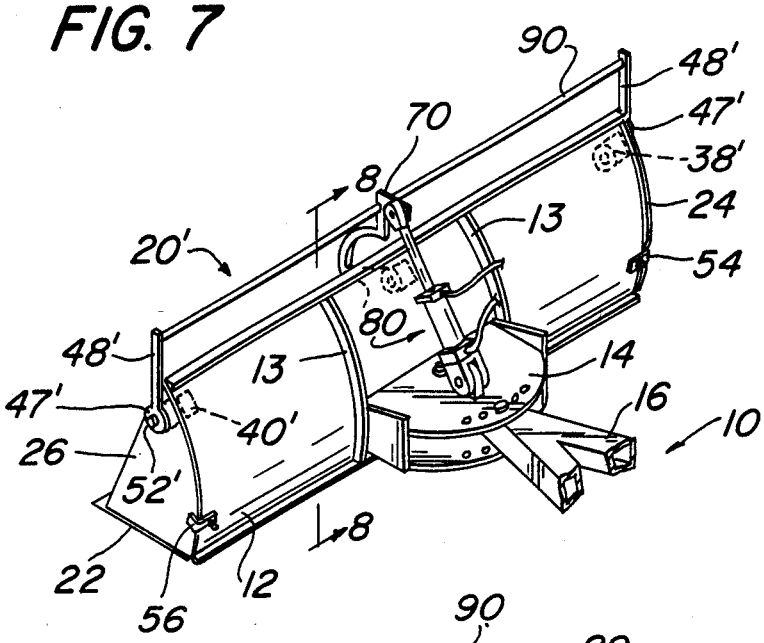
FIG. 7 is a perspective view showing another embodiment of the invention.
Figure 8:
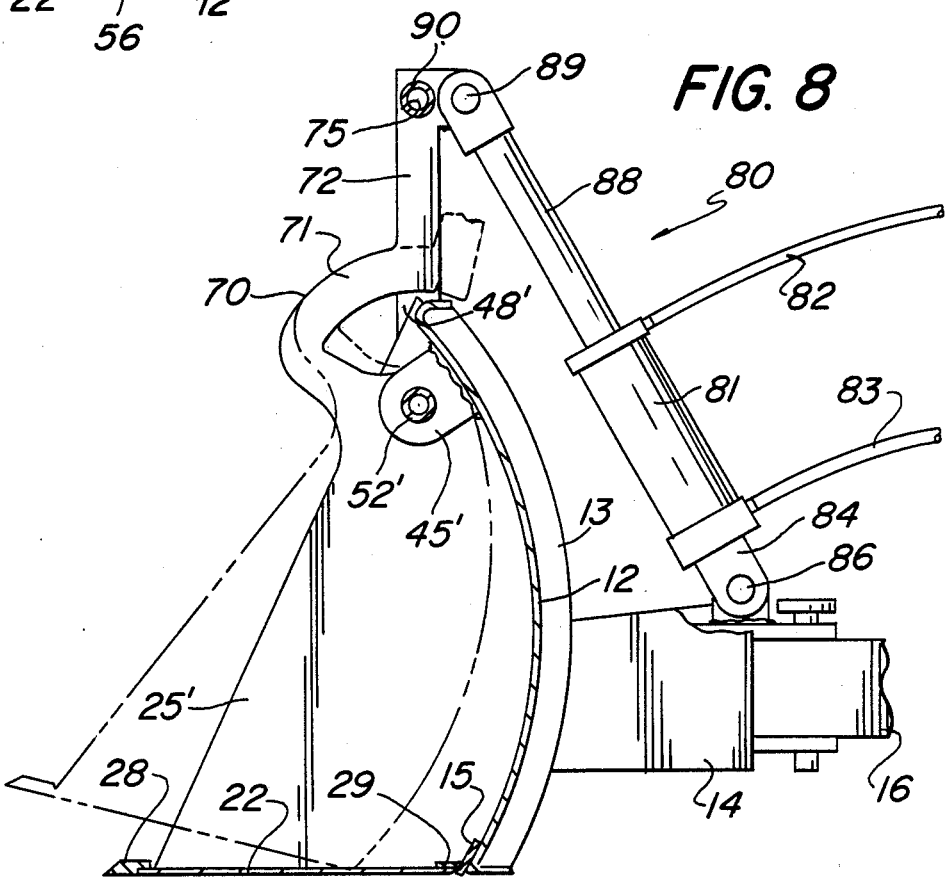
FIG. 8 is a sectional view taken on line 8–8 of FIG. 7.

The embodiment of the invention shown in FIGS. 1–6 is designed to be added onto existing snow blades and, of course, is manually operated. In FIGS. 7 and 8 there is provided power operated attachment that is actuated by means of a hydraulic cylinder and is designed so that it can be more easily installed as part of the original equipment provided with a tractor. However, as will be apparent, the embodiment of the invention shown in FIGS. 7 and 8 could be added onto an existing tractor and snow blade arrangement with appropriate modifications to the equipment, as by the provision of brackets or the like.

The embodiment of the invention shown in FIGS. 7 and 8 comprises parts which are identical to that of the embodiment shown in FIGS. 1–6 and such identical parts have been given the same reference numeral. Furthermore, the embodiment of the invention shown in FIGS. 7 and 8 comprises parts which are equivalent to parts in the embodiments shown in FIGS. 1–6 but have been modified, and such modified parts have been given corresponding reference numerals with primes added.

Referring now to FIGS. 7 and 8, the attachment shown therein is adapted for use with a garden type tractor 10 having a snow blade 12 mounted on the forward end thereof by means of a support 14 and a frame member 16. The snow blade 12 has a curved shape and is provided with a pair of curved braces 13 as shown in FIG. 7.

The attachment shown in FIGS. 7 and 8 comprises a rigid bucket structure 20′ which includes an elongated bottom 22, a pair of side members 24 and 26 and a third member 25′, all constructed and arranged in the same manner as the embodiment shown in FIGS. 1–6. The bottom 22 has a front metal strip 28 welded thereto and a rear metal strip 29 welded thereto. The bottom 22, the members 24, 25′ and 26, the metal strips 28 and 29 are all welded together to form the rigid bucket structure 20′.

As shown in FIG. 8, the third member 25′ has an arm 70 extending upwardly and having a curved portion 71 and a straight portion 72 as is best shown in FIG. 8.

There are provided means for pivotally mounting the bucket structure 20′ on the snow blade 12 to extend forwardly therefrom. Such means comprises pivot supports mounted at each of the members 24, 25′ and 26. To this end, the pivot support at side member 24 comprises a generally annular bearing member 38′ welded on snow blade 12 adjacent the inner face of side member 24 and an annular end portion 47′ of a crank arm 48′, the pivot support at medial member 25′ comprises an annular bearing member 45′ welded on snow blade 12 at medial member 25′ (FIG. 8), and the pivot support at side member 26 comprises a generally annular bearing member 40′ welded on snow blade 12 at the inner face of side member 26 and an annular end portion 47′ of another crank arm 48′ welded to side member 26 on the outer face thereof. Alternatively, bearing members 38′ and 40′ may be secured to snow blade 12 by means of brackets bolted thereto. The parts are constructed and arranged so that pivot supports 38′, 40′, 45′ and 47′ have their central holes in axial alignment with an axis extending generally horizontally across the top portion of the snow blade 12. The pivot means also comprises a pivot shaft 52′ which is adapted to extend through the holes in the pivot supports 38′–47′, the pivot shaft 52′ being secured in position by cotter pins.

There are provided a pair of right angular shaped brackets 54 and 56 constructed and arranged in a manner described above with respect to FIGS. 1–6 and operative to guide the bucket structure 20′ into and stop the bucket structure 20′ at the closed position thereof shown in FIG. 7 and in solid lines in FIG. 8.

As is shown in the Drawings, the side members 24 and 26 and the cooperating stop and guide members 54 and 56 are constructed and arranged so that the side members 24 and 26 overlap the end portions of the snow blade 12 in the closed position of the bucket structure 20′.

There are provided power operated means for actuating the bucket structure 20′ between the closed and open positions thereof. Such means comprises a hydraulic cylinder means 80 mounted on the support member 14 in the position shown in FIGS. 7 and 8. To this end, the hydraulic cylinder means 80 comprises a hydraulic cylinder 81 having a piston therein (not shown) and hydraulic supply lines 82, 83 for delivering hydraulic fluid to opposite sides of the piston. At its lower end, the cylinder 81 is pivotally mounted by a yoke structure 84 on a horizontally extending pivot 86 mounted on the support structure 14. The actuating rod 88 of the hydraulic cylinder means 80 is connected to the piston internally of the cylinder 81 and has its extended end pivotally connected to the upper end of the arm 70 formed on member 25′ at a horizontally extending pivot pin 89.

The parts are constructed and arranged so that when the cylinder means 80 is actuated hydraulically to extend the piston rod 88 to its extended position, as shown in FIGS. 7 and 8, the bucket structure 20′ will be in the closed position. Also, when the piston rod 88 is hydraulically actuated to be moved to its retracted position, the bucket structure 20′ will be moved to its open or dump position. In FIG. 8, there is shown in dashed lines the position of the bucket structure 20′ in a partially opened position.

The embodiment shown in FIG. 7 is provided with a rod 90 for transmitting the actuating forces of the hydraulic cylinder means 80 to each of the members 24, 25′ and 26. To this end, rod 90 is connected at its ends to the upper portion of the two crank arms 48′ and extends through a hole 75 at the upper end of the straight portion 72 of arm 70. By this arrangement, the actuating force applied to pin 89 is transmitted to the three vertically extending crank arm portions 48′, 72 and 48′ secured to members 24, 25′ and 26, respectively, as will be apparent from a consideration of the Drawings.

While there have been shown and described what are considered to be preferred forms of the invention, it will be understood that obvious changes in form can be made without departing from the spirit of the invention and it is therefore intended that the invention be not limited to precise forms herein described and that the invention is to be considered broadly and restricted by the following appended claims.

What is claimed is:

1. An easily removable attachment for a garden-type tractor or the like having a snow blade or the like mounted on the front end thereof to extend across the front of the tractor in a generally vertically extending position, said snow blade having a smooth arcuate front face without sides or other forward projections obstructing flow of material from the ends thereof, said attachment being constructed and arranged to cooperate with the snow blade to provide a dump bucket at the front end of the tractor thereby converting the same into a dumping device and comprising a generally flat bottom adapted to extend forwardly from and along the length of the snow blade when attached thereto, a first side member mounted at one end of said bottom to extend transversely thereto, a second side member mounted at the other end of said bottom to extend transversely thereto, said bottom and said first and second side members being constructed and arranged to form a rigid bucket structure having a shape to cooperate with the snow blade to form a bucket for carrying material with said first and second side members forming the entire side walls of said bucket, and means for pivotally mounting said bucket structure on said snow blade to be easily attached and removed and to extend forwardly therefrom, said pivotal mounting means including a first bracket mounted to the blade front face adjacent the upper edge thereof and adjacent said one end of said snow blade, a second bracket mounted to the blade front face adjacent the upper edge thereof and adjacent the other end of said snow blade, each of said brackets having a pivot support thereon, each of said side members having a pivot support thereon, and pivot means cooperable with said pivot supports of said brackets and said side members to provide a pivotal axis about which said bucket structure is pivotable between a closed load carrying position and an open dumping position.

2. An attachment according to claim 1 wherein said pivotal axis is arranged to extend along an upper portion of the snow blade, said pivot means including a bar freely mounted within said pivot supports so that said bucket structure is pivotable relative thereto.

3. An attachment according to claim 1 wherein said bottom includes means providing a forward edge having a sharp configuration and made of a hard material so as to facilitate the movement of the bottom into the material to be moved.

4. An attachment according to claim 1 including means for guiding and stopping said bucket structure at said closed position thereof.

5. An attachment according to claim 4 wherein said guiding and stopping means includes a first stop member mounted on said one end of said snow blade to guide said first side member into and stop the same in said closed position and a second stop member mounted on said other end of said snow blade to guide said second side member into and stop the same in said closed position.

6. An attachment according to claim 1 wherein said blade front face is free of openings or obstructions, and said first and second side members are constructed and arranged to overlap the end portions of said snow blade in said closed position of said bucket structure to thereby prevent the escape of material from the interior chamber of the bucket structure.

7. An attachment according to claim 1 wherein each of said bracket pivot supports is arcuate to conform to said blade front face and comprises an annular lug mounted to extend forwardly of said snow blade with the holes thereof in axial alignment.

8. An attachment according to claim 7 wherein each of said pivot supports of said side members comprises a generally annular member having a central hole therein, all of said central holes of said pivot supports of said side members being in axial alignment.

9. An attachment according to claim 8 wherein said pivot means comprises an elongated shaft constructed and arranged to extend through said holes in said pivot supports of said bracket and said central holes in said pivot supports of said side members, and including means for locking said shaft in a pivot position thereof.

10. An attachment according to claim 1 including bolt means for mounting said first and second brackets on said snow blade.

11. An attachment according to claim 1 including means for manually actuating said bucket structure between said closed and open positions thereof, said actuating means including a crank arm secured to said bucket structure to extend upwardly therefrom and being adapted to have a manually operable link means connected thereto.

12. An easily attached and removable attachment for a garden-type tractor or the like having a snow blade or the like mounted on the front end thereof to extend across the front of the tractor in a generally vertically extending position, said snow blade having a smooth arcuate front face without sides or other forward projections obstructing flow of material from the ends thereof, said attachment being constructed and arranged to cooperate with the snow blade to provide a dump bucket at the front end of the tractor thereby converting the same into a dumping device and comprising a generally flat bottom adapted to extend forwardly from and along the length of the snow blade when attached thereto, a first side member mounted on one end of said bottom to extend transversely thereto, a second side member mounted on the other end of said bottom to extend transversely thereto, said bottom and said first and second side members being constructed and arranged to form a rigid bucket structure having a shape to cooperate with the snow blade to form a bucket for carrying material with said first and second side members forming the entire side walls of said bucket, and means for pivotally mounting said bucket structure on said snow blade to extend forwardly therefrom including bracket means mounted to the blade front face adjacent the upper edge thereof.

13. An attachment according to claim 12 including pivot means providing a pivotal axis about which said bucket structure is pivotable between a closed load carrying position and an open dumping position and means for actuating said bucket structure between said closed and open positions thereof, said actuating means including power-operated means.

14. An attachment according to claim 13 wherein said actuating means includes a crank arm secured to said bucket structure to extend upwardly therefrom and means for operatively connecting said power-operated means to said crank arm.

15. An attachment according to claim 14 wherein said actuating means includes a second crank arm secured to said bucket structure at said first side member and a third crank arm secured to said bucket structure at said second side member, and means interconnecting all of said crank arms for conjoint movement thereof.

16. An attachment according to claim 15 wherein said first-mentioned crank arm is secured to said bucket structure at a generally medial location between said side members.

17. An attachment according to claim 16 wherein said means interconnecting said crank arms comprises a rod connected to the extended ends of said crank arms.

* * * * *